US007126278B2

(12) United States Patent
Lin et al.

(10) Patent No.: US 7,126,278 B2
(45) Date of Patent: Oct. 24, 2006

(54) ELECTRODE STRUCTURE, FABRICATION METHOD THEREOF AND PDP UTILIZING THE SAME

(75) Inventors: Chia-Hsin Lin, Kaohsiung (TW); Pei-Yu Chen, Sanchong (TW)

(73) Assignee: AU Optronics Corp., Hsinchu (TW)

( * ) Notice: Subject to any disclaimer, the term of this patent is extended or adjusted under 35 U.S.C. 154(b) by 151 days.

(21) Appl. No.: 10/875,773

(22) Filed: Jun. 24, 2004

(65) Prior Publication Data

US 2005/0224801 A1 Oct. 13, 2005

(30) Foreign Application Priority Data

Apr. 12, 2004 (TW) ..... 93110088 A

(51) Int. Cl.
*H01J 17/49* (2006.01)

(52) U.S. Cl. ..... 313/582; 313/584; 315/169.4

(58) Field of Classification Search ..... 345/55, 345/60; 313/582–585; 315/169.4
See application file for complete search history.

(56) References Cited

U.S. PATENT DOCUMENTS 6,538,381 B1 * 3/2003 Ueoka et al. ..... 313/582
2001/0026255 A1 * 10/2001 Sano et al. ..... 345/60

* cited by examiner

*Primary Examiner*—Minh-Loan Tran
(74) *Attorney, Agent, or Firm*—Thomas, Kayden, Horstemeyer & Risley

(57) ABSTRACT

An electrode structure for a front board of a plasma display panel (PDP). The electronic structure connects all the sustain electrodes on the front board to prevent data transformation errors caused by holes. The fabrication method of the electronic structure is also disclosed.

11 Claims, 10 Drawing Sheets

ELECTRODE STRUCTURE, FABRICATION METHOD THEREOF AND PDP UTILIZING THE SAME

BACKGROUND OF THE INVENTION

1. Field of the Invention

The present invention relates to an electrode structure, and more particularly to an electrode structure appropriate for a front board of a plasma display panel (PDP) and fabrication method thereof.

2. Description of the Related Art

PDPs are generally divided into alternating current (AC) and direct current (DC) types. The AC type PDP comprises a front board and a back board. Bus electrodes are formed on the front board. Data electrodes are formed on the back board. The front and back boards are typically glass substrates. The bus electrodes are composed of photosensitive electrode material.

In order to increase the shading values of pixels, the bus electrodes utilize two coats of a screen printing material. As shown in FIG. 1*a*, a dark color electrode material covers a front board 1 to form a dark color layer 3 and a light color electrode material covers the dark color layer 3 to form a light color layer 5.

The dark color electrode material is ruthenium and the light color electrode material is silver. The electrode material of the dark color layer 3 and the light color layer 5 is different such that shrinkage of the dark color layer 3 and light color layer 5 is not the same. As shown in FIG. 1*b*, if the shrinkage of the dark color electrode material is more than the light color electrode material, edges of the front board 1 with curl.

In order to solve the uneven shrinkage problem, a conventional method is used to control areas of the dark color layer 3 and the light color layer 5. FIG. 2*a* shows a conventional front board. A dark color layer 4 is formed on a front board 2 and a light color layer 6 is formed on the dark color layer 4. The area of the light color layer 6 is greater than the area of the dark color layer 4. When a scraper of a screen printing tool contacts the light color layer 6 moving from left to right, a hole 8 is generated in a left terminal of the dark color layer 4, as shown in FIG. 2*b*.

FIG. 2*c* shows a top view of a conventional front board. An electrode pattern comprising electrodes $X_1$~$X_n$ is formed in the front board. When the hole 8 appears in the electrode $X_1$, the electrode $X_1$ is cut off and malfunctions resulting in reduced PDP yield of the PDP to reduce.

SUMMARY OF THE INVENTION

An object of the present invention is to provide an electrode structure and an electrode fabrication method for preventing electrodes hole cut-off.

Accordingly, the present invention provides an electrode fabrication method. First, a substrate comprising a first region and a second region is provided. A first conductive layer is then formed overlying the first region. Next, a second conductive layer is formed overlying the first region and the second region. Finally, the second conductive layer and the underlying first conductive layer are patterned to form an electrode pattern. The electrode pattern comprises a first electrode line, a second electrode line, and a connection segment. The first electrode line and the second electrode line are disposed in parallel and formed on the first region and the second region. The connection segment connects the first electrode line and the second electrode line in the first region.

Accordingly, the present invention also provides a front board of a plasma display panel (PDP). A first region and a second region are defined on the front board. The first region is capable of displaying an image and the second region has a display driving circuit. The electrode structure comprises at least two electrode lines disposed in parallel and a connection segment. Each electrode line comprises a first segment and a second segment. The structures of the first segment and the second segment are different. The first segment is formed on the first region and the second segment on the second region. The connection segment is formed on the first region for connecting the electrode lines.

BRIEF DESCRIPTION OF THE DRAWINGS

The present invention can be more fully understood by reading the subsequent detailed description and examples with reference made to the accompanying drawings, wherein.

DETAILED DESCRIPTION OF THE INVENTION

FIGS. 3*a* to 3*d* are cross-sections showing an electrode fabrication method of the present invention. First, in FIG. 3*a*, a glass substrate 100 comprises a first region 11, a second region $C_1$ and a third region $C_2$. The first region 11 comprises a display region A and a buffer region B. Bus electrodes comprise sustain electrodes and scan electrodes. A sustain electrode driving circuit is disposed in the second region $C_1$. A scan electrode driving circuit is disposed in the third region $C_2$. The buffer region B is disposed between the display region A and the second region $C_1$.

Figure 1A:
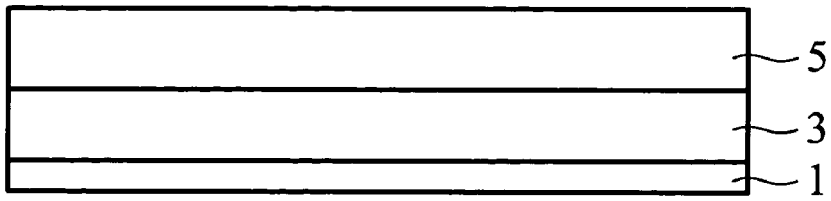
FIG. 1a ( RELATED ART )
FIGS. 1*a* to 1*b* are cross-sections showing a conventional electrode fabrication method.
Figure 1B:
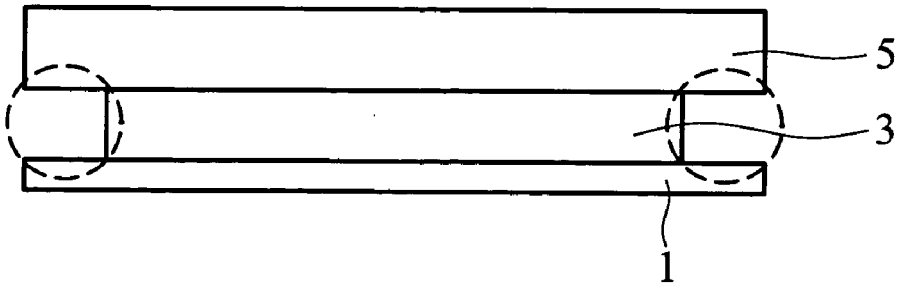
FIG. 1b ( RELATED ART )
Figure 2A:
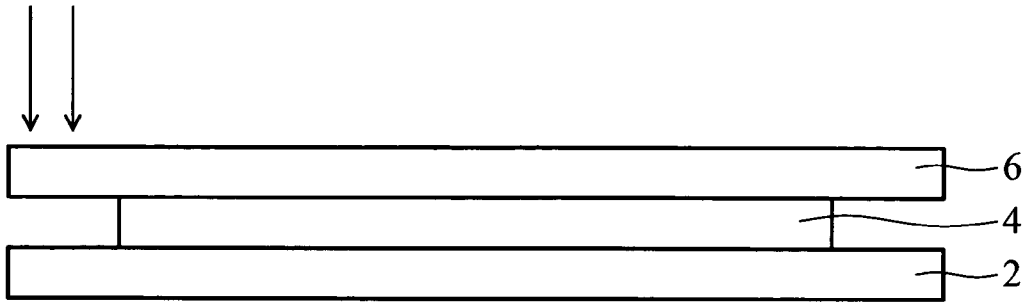
FIG. 2a ( RELATED ART )
FIGS. 2*a* to 2*c* are cross-sections showing another conventional electrode fabrication method.
Figure 2B:
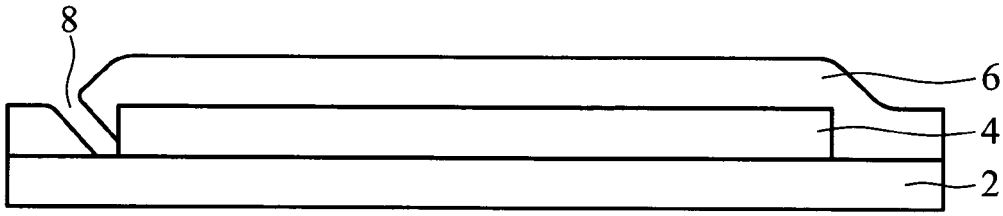
FIG. 2b ( RELATED ART )
Figure 2C:
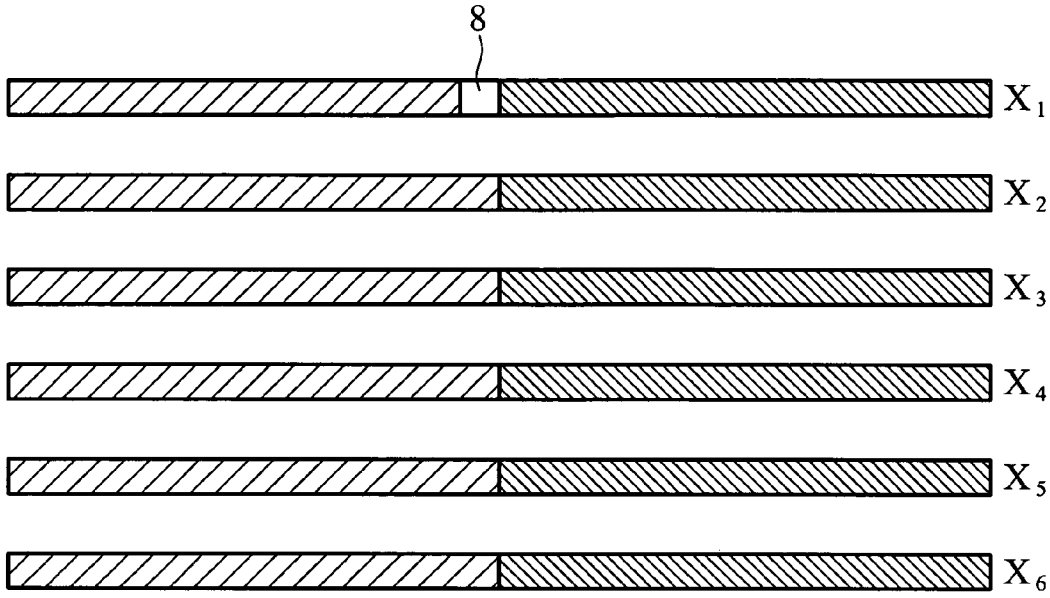
FIG. 2c ( RELATED ART )
Figure 3A:
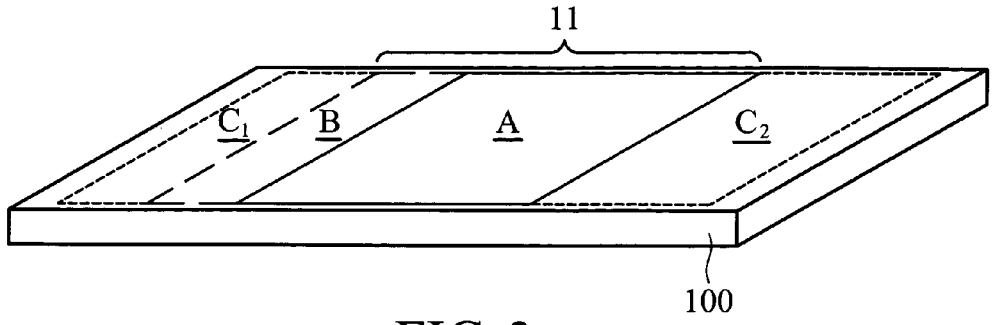
FIGS. 3*a* to 3*d* are cross-sections showing an electrode fabrication method of the present invention.
Figure 3B:
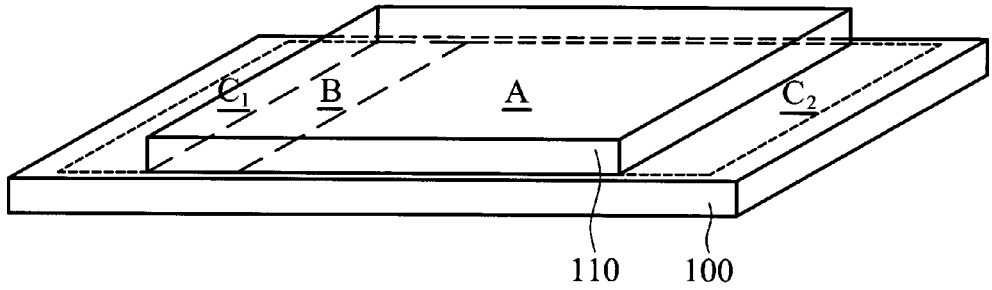

Next, as shown in FIG. 3*b*, a first conductive layer 110 is formed overlying the display region A and the buffer region B.

Figure 3C:
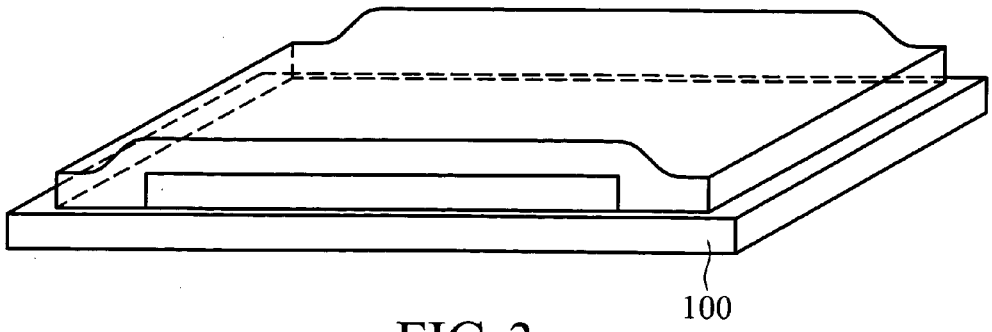

Next, as shown in FIG. 3*c*, a second conductive layer 120 is formed overlying the display region A, the buffer region B, the first region $C_1$ and the third region $C_2$. A scraper of a screen printing tool moves from a left terminal to a right terminal of the glass substrate 100 such that the second conductive layer 120 completely covers the glass substrate 100 and the first conductive layer 110. Generally, the first conductive layer 110 is a dark color layer and the second conductive layer 120 is a light color layer.

Figure 3D:
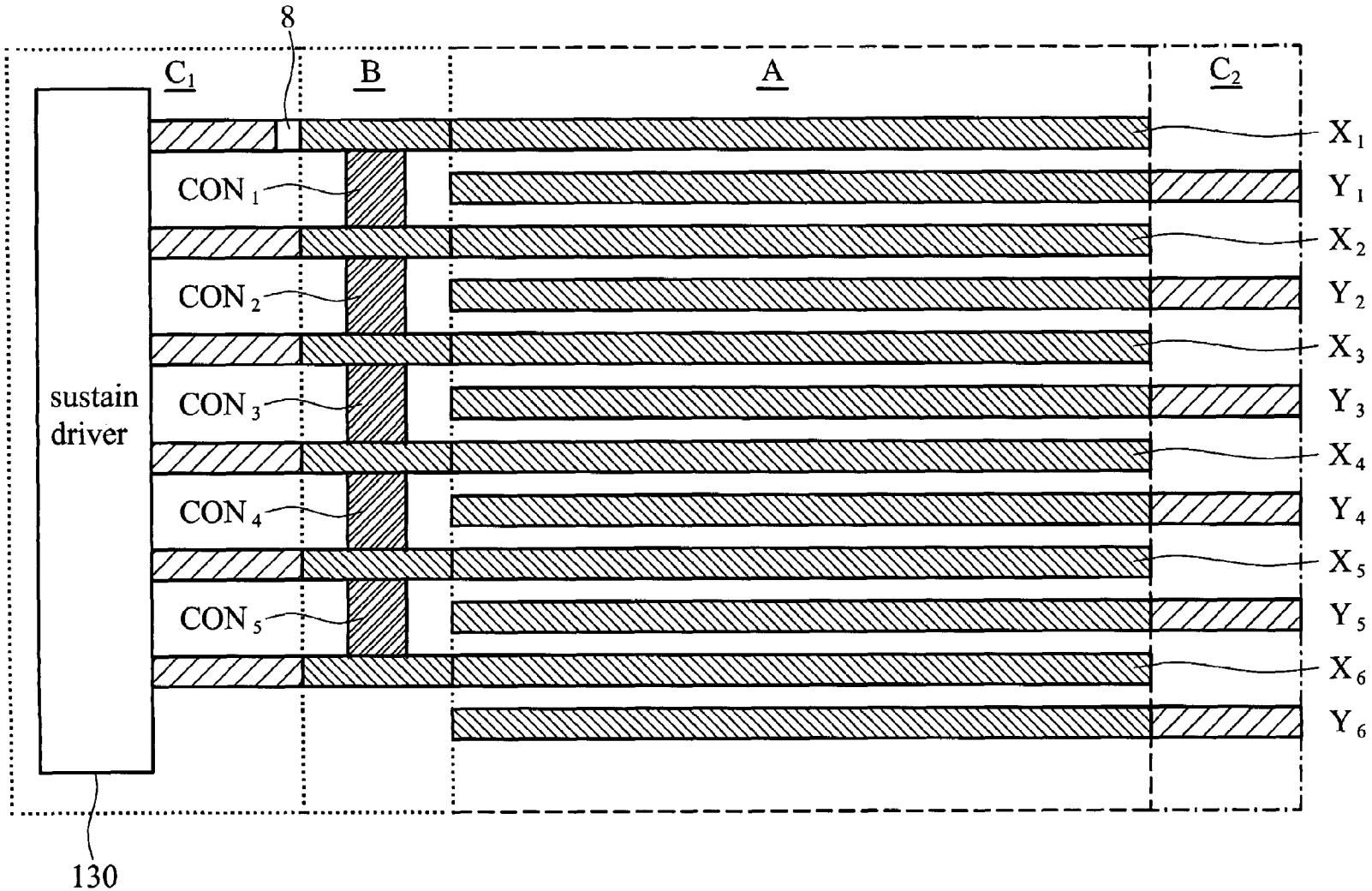

Finally in FIG. 3*d*, the first electrode layer 110 and the second electrode layer 120 are patterned to form an electrode pattern on the glass substrate 100. The display region A and the buffer region B have the first conductive layer 110 and the second conductive layer 120. The first region $C_1$ and the third region $C_2$ have only the second conductive layer 120.

The electrode pattern comprises sustain electrodes $X_1$~$X_6$ and connection segments $CON_1$~$CON_5$. The sustain electrodes $X_1$~$X_6$ are connected in parallel. The connection segments $CON_1$~$CON_5$ are formed in the buffer region B and connect to the sustain electrodes $X_1$~$X_6$. For example, the connection segment $CON_1$ connects the sustain electrodes $X_1$ and $X_2$, and the connection segment $CON_2$ connects the sustain electrodes $X_2$ and $X_3$. The electrode pattern further comprises scan electrodes $Y_1$~$Y_6$ between the sustain electrodes $X_1$~$X_6$. The scan electrodes $Y_1$~$Y_6$ are formed in the display region A and the third regions $C_2$.

A sustain driver 130 outputs identical sustain signals to the sustain electrodes $X_1$~$X_6$. If a hole 8 occurs in a right terminal of the second region $C_1$ of the sustain electrodes $X_1$, the sustain signal is received through the connection segment $CON_1$. When a hole occurs in any one sustain electrode, the sustain signal is received through connection segments.

In this embodiment, although the connection segments $CON_1$~$CON_5$ are formed in the buffer region B and connected to the sustain electrodes $X_1$~$X_6$, the present invention neither limits the location of the connection segments $CON_1$~$CON_5$ nor the connection relationship between the connection segments $CON_1$~$CON_5$ and the sustain electrodes $X_1$~$X_6$.

Figure 4:
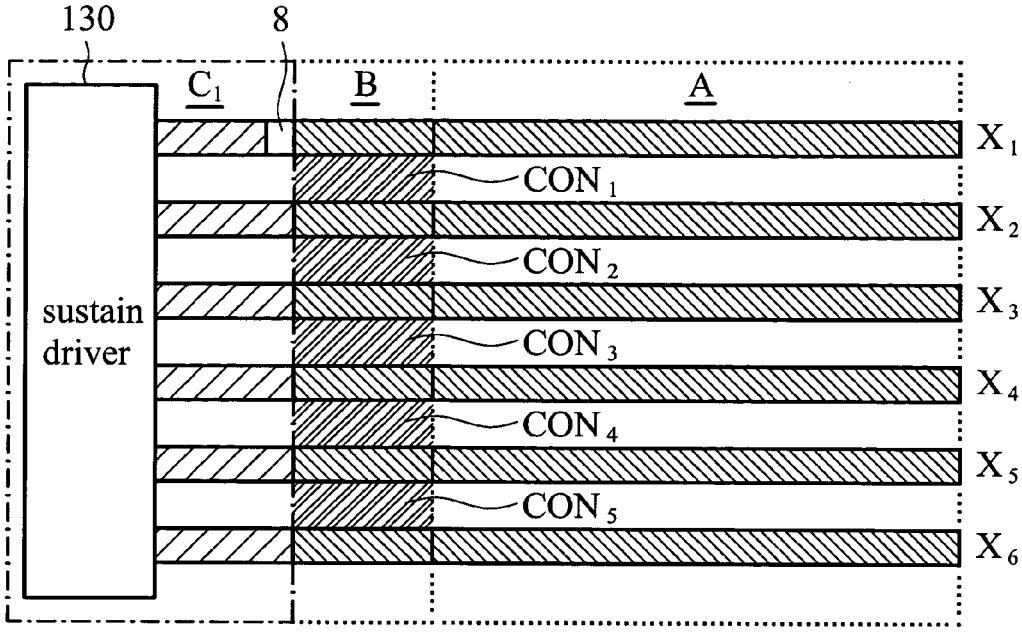
FIG. 4 is a top-view of the electrode structure of a second embodiment.

Various connection methods are disclosed in the following. FIG. 4 is a top-view diagram of the electrode structure of a second embodiment of the invention. The connection segments $CON_1$~$CON_5$ connect the sustain electrodes $X_1$~$X_6$ covering the entire buffer region B. If a hole 8 occurs in the right terminal of the second region $C_1$ of the sustain electrodes $X_1$, the sustain signal is received through the connection segment $CON_1$.

Figure 5:
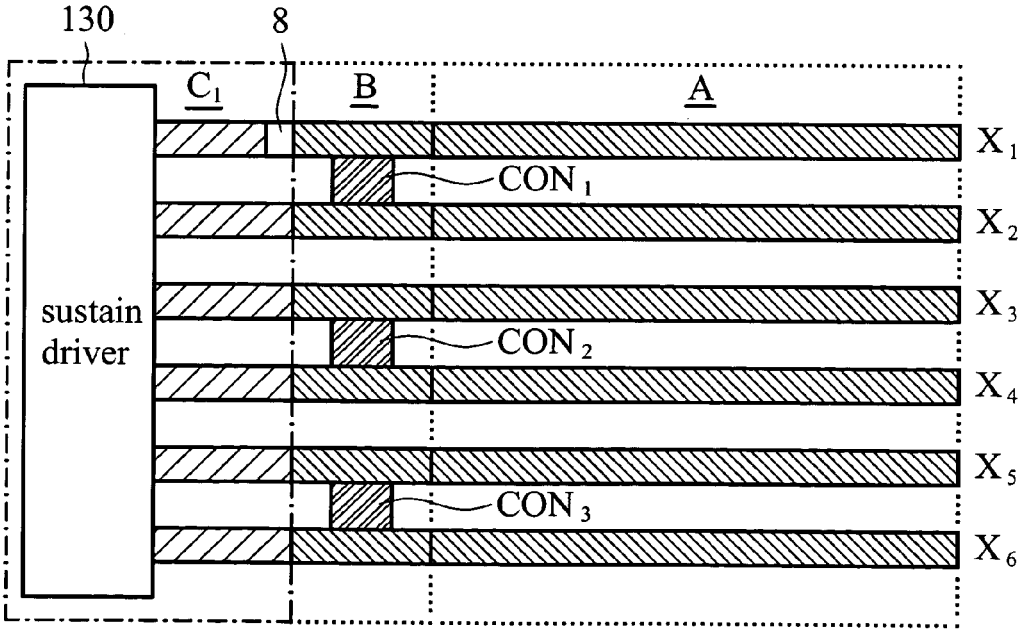
FIG. 5 is a top-view of the electrode structure of a third embodiment.

FIG. 5 is a top-view diagram of the electrode structure of a third embodiment. The connection segments $CON_1$~$CON_3$ cover a portion of the buffer region B. The connection segment $CON_1$ connects the sustain electrodes $X_1$ and $X_2$. The connection segment $CON_2$ connects the sustain electrodes $X_3$ and $X_4$. The connection segment $CON_3$ connects the sustain electrodes $X_5$ and $X_6$. Therefore, each sustain electrode is connected to the neighboring sustain electrode through at least one connection segment. If a hole 8 occurs in the right terminal of the second region $C_1$ of the sustain electrodes $X_1$, the sustain signal is received through the connection segment $CON_1$.

A characteristic of the present invention is that each sustain electrode is connected to one or more sustain electrodes through the connection segment.

Figure 6:
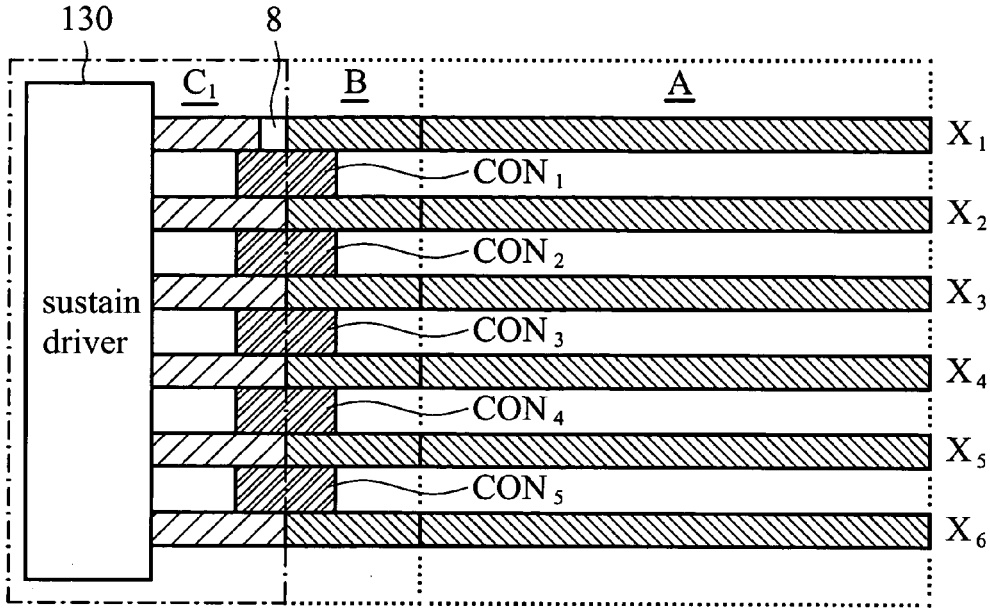
FIG. 6 is a top-view of the electrode structure of a fourth embodiment.

FIG. 6 is a top-view diagram of the electrode structure of a fourth embodiment. The connection segments $CON_1$~$CON_5$ connect the sustain electrodes $X_1$~$X_6$, and cover part of the buffer region B and part of the second regions $C_1$.

Figure 7:
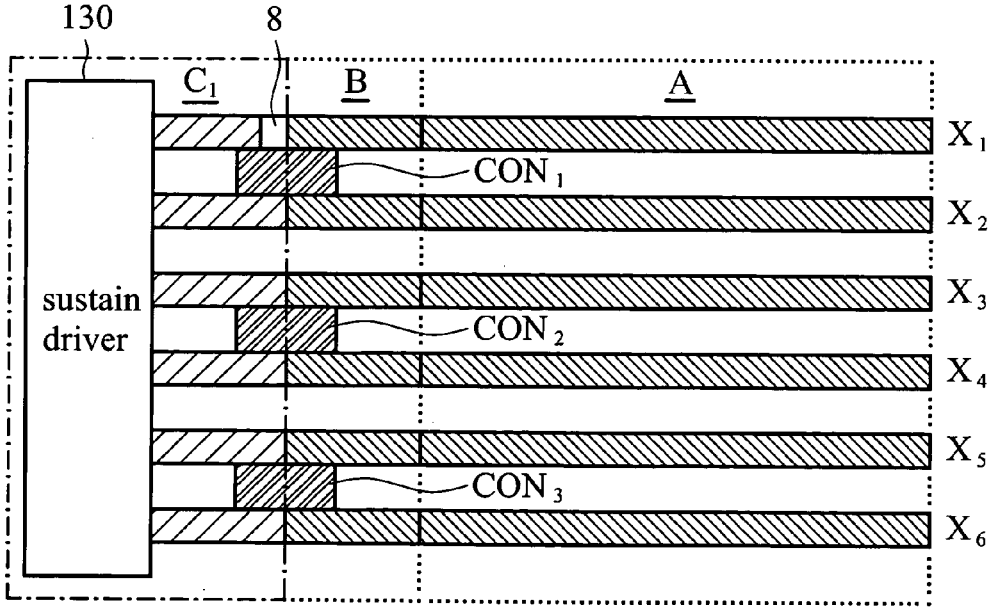
FIG. 7 is a top-view of the electrode structure of a fifth embodiment.

FIG. 7 is a top-view diagram of the electrode structure of a fifth embodiment. The connection segments $CON_1$~$CON_3$ cover a portion of the buffer region B and a portion of the second regions $C_1$. In the buffer region B, the connection segments $CON_1$~$CON_3$ comprise the first conductive layer 110 and the second conductive layer 120. In the second regions $C_1$, the connection segments $CON_1$~$CON_3$ have only the second conductive layer 120. The connection segment $CON_1$ connects the sustain electrodes $X_1$ and $X_2$. The connection segment $CON_2$ connects the sustain electrodes $X_3$ and $X_4$. The connection segment $CON_3$ connects the sustain electrodes $X_5$ and $X_6$.

Figure 8:
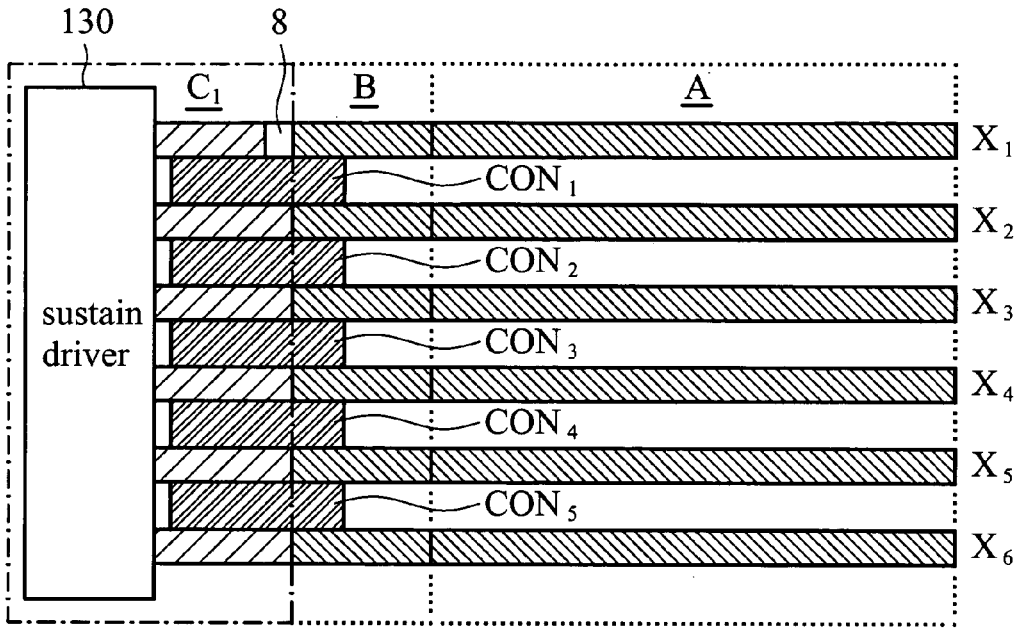
FIG. 8 is a top-view of the electrode structure of a sixth embodiment.

FIG. 8 is a top-view diagram of the electrode structure of a sixth embodiment. The connection segments $CON_1$~$CON_5$ connect the sustain electrodes $X_1$~$X_6$, and cover a portion of the buffer region B and the greater portion of the second regions $C_1$.

Figure 9:
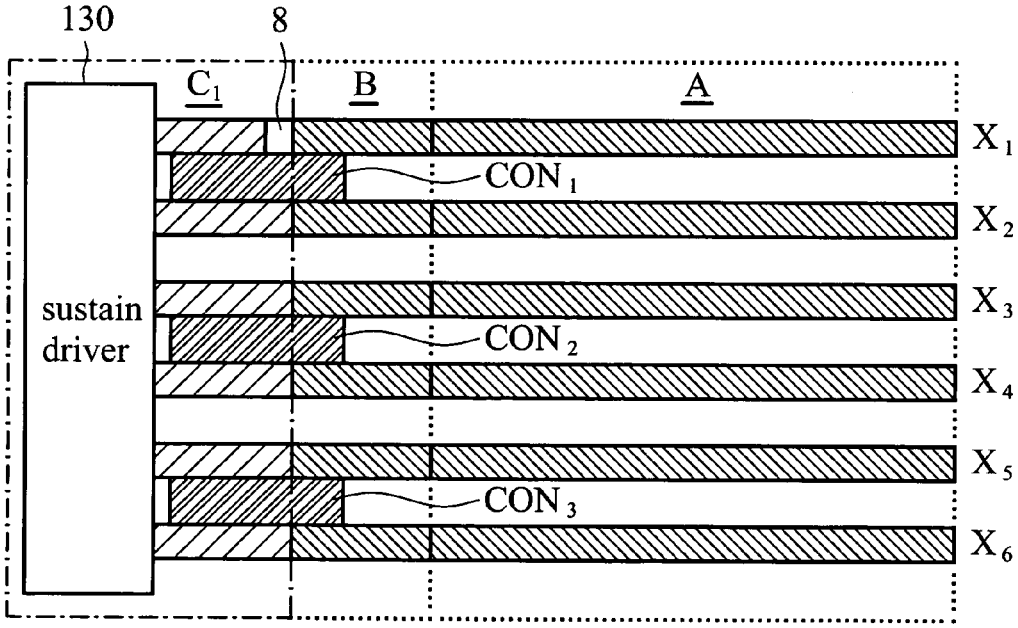
FIG. 9 is a top-view of the electrode structure of a seventh embodiment.

FIG. 9 is a top-view diagram of the electrode structure of a seventh embodiment. The connection segments $CON_1$~$CON_3$ connect the sustain electrodes $X_1$~$X_6$, and cover a portion of the buffer region B and the greater portion of the second regions $C_1$. The connection segment $CON_1$ connects the sustain electrodes $X_1$ and $X_2$. The connection segment $CON_2$ connects the sustain electrodes $X_3$ and $X_4$. The connection segment $CON_3$ connects the sustain electrodes $X_5$ and $X_6$.

Figure 10:
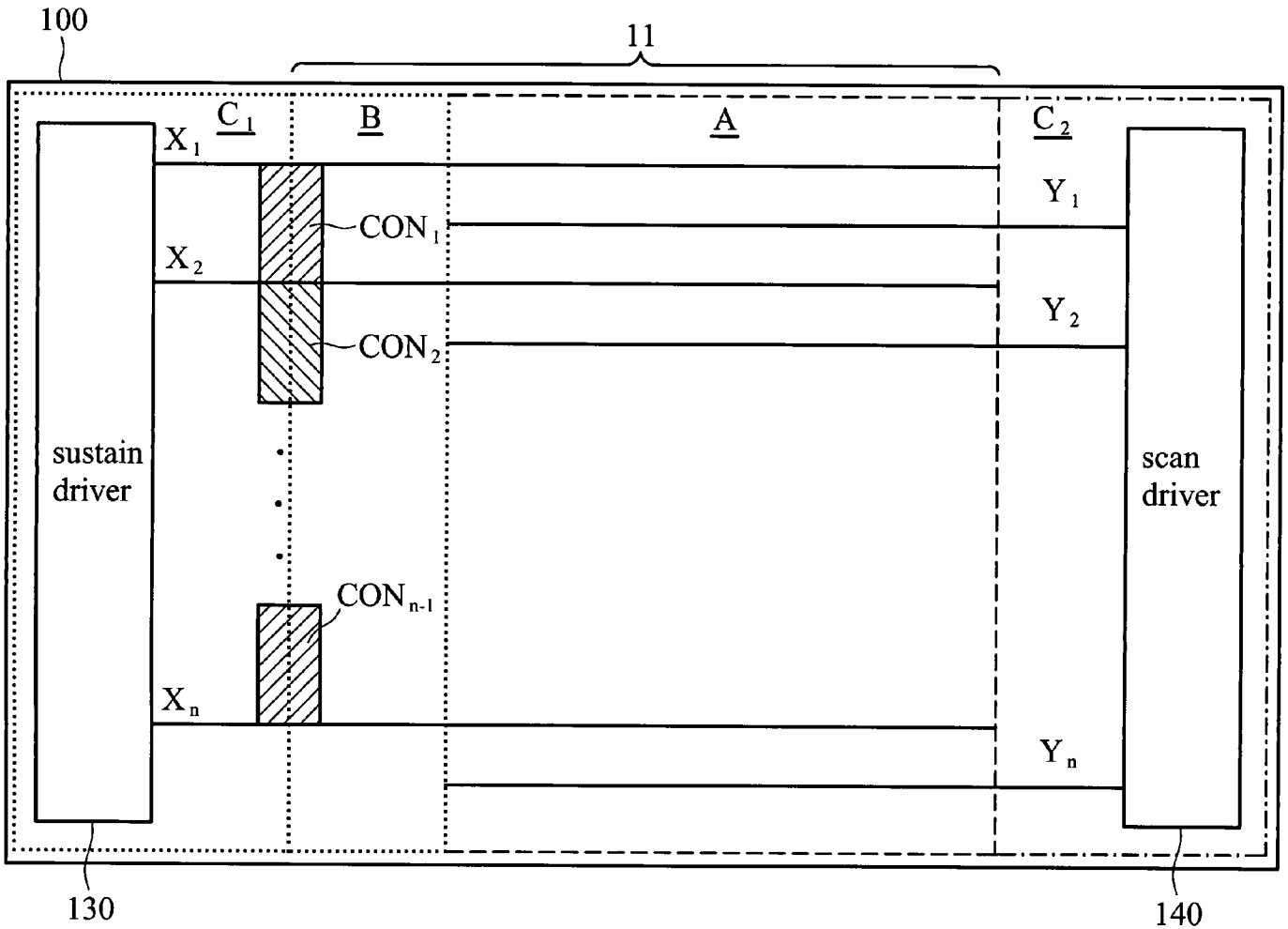
FIG. 10 is a structural diagram of a front board of a PDP.

FIG. 10 is a structural diagram of a front board of a PDP. The front board 100 comprises first region 11 and second region $C_1$. The first region 11 is capable of displaying an image. The second region $C_1$ has a sustain driver 130. The bus electrodes of the front board 100 comprise sustain electrodes $X_1$~$X_n$ and scan electrodes $Y_1$~$Y_n$.

Sustain electrodes $X_1$~$X_n$ are disposed in parallel. Each sustain electrode comprises a first segment formed on the first region 11 and a second segment formed on the second region $C_1$. The first region 11 has a laminated construction with first conductive material layer. The second region $C_1$ has only second conductive material layer. Connection segments $CON_1$~$CON_{n-1}$ form on the first region 11 for connecting sustain electrodes $X_1$~$X_n$.

The first region 11 comprises display region A for displaying an image and buffer region B between the first region 11 and second region $C_1$ for disposing connecting connection segments $CON_1$~$CON_{n-1}$. In this embodiment, connection segments $CON_1$~$CON_{n-1}$ form on a portion of buffer region B and second region $C_1$.

In addition, the front board 100 further comprises scan electrodes $Y_1$~$Y_n$ controlled by a scan driver 140 and formed on display region A and third region $C_2$.

When a hole 8 occurs in the right terminal of the second region $C_1$ of any one sustain electrode, the sustain electrode also receives the sustain signal through the connection segment.

Figure 11:
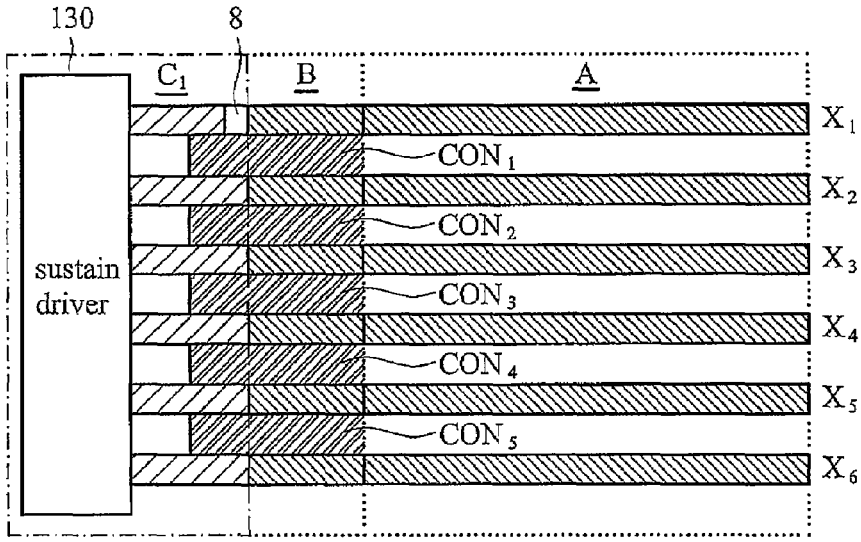
FIG. 11 is a top-view of the electrode structure of an eighth embodiment.

FIG. 11 is a top-view of the electrode structure of an eighth embodiment. The connection segments $CON_1$~$CON_5$ connect the sustain electrodes $X_1$~$X_6$, and cover the entire buffer region B and a portion of the second regions $C_1$.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electrode structure for a front board of a plasma display panel (PDP), wherein the front board is defined with a first region and a second region and the first region is capable of displaying an image and the second region has a display driving circuit, comprising:

at least two electrode lines disposed in parallel, each comprising a first segment and a second segment, wherein the first segment and the second segment have different composing structures, the first segment is fanned on the first region, and the second segment is formed on the second region; and a connection segment formed on the first region for connecting the electrode lines.

2. The electrode structure as claimed in claim 1, wherein the electrode lines are sustain electrodes.

3. The electrode structure as claimed in claim 1, wherein the first region comprises a display region for displaying the image and a buffer region for disposing the connection segment between the display region and the second region.

4. The electrode structure as claimed in claim 3, wherein the connection segment forms on a portion of the buffer region.

5. The electrode structure as claimed in claim 4, wherein the connection segment further forms on a portion of the second region.

6. The electrode structure as claimed in claim 3, wherein the connection segment forms on the entire of buffer region.

7. The electrode structure as claimed in claim 6, wherein the connection segment further forms on a portion of the second region.

8. The electrode structure as claimed in claim 1, wherein two electrode lines and the connection segment are composed of photosensitive electrode material.

9. The electrode structure as claimed in claim 1, wherein the first segment and the connection segment have a laminated construction with a first conductive material layer and a second conductive material layer and wherein the second segment has only the second conductive material layer.

10. An electrode structure for a front board of a plasma display panel (PDP), wherein the front board is defined with a first region and a second region and the first region is capable of displayi.ng an image and the second region has a frame driving circuit, comprising:

a plurality of sustain electrodes disposed in parallel, each comprising a first segment and a second segment, wherein the first segment and the second segment have different composing-structures, the first segment forms on the first region, and the second segment forms on the second region; and a plurality of connection segments connecting neighboring sustain electrodes and comprising a laminated construction with a first conductive material layer and a second conductive material layer.

11. The electrode structure as claimed in claim 10, wherein the first region comprises a display region for displaying the image and a buffer region for disposing the connection segment between the display region and the second region.

* * * * *

UNITED STATES PATENT AND TRADEMARK OFFICE

CERTIFICATE OF CORRECTION

PATENT NO. : 7,126,278 B2
APPLICATION NO. : 10/875773
DATED : October 24, 2006
INVENTOR(S) : Lin et al.

It is certified that error appears in the above-identified patent and that said Letters Patent is hereby corrected as shown below:

In the Claims

Column 5, Line 5, please replace “fanned” with “formed”

Signed and Sealed this
Seventeenth Day of June, 2014

Michelle K. Lee

Michelle K. Lee
*Deputy Director of the United States Patent and Trademark Office*